US010617233B2

(12) United States Patent
Ertl

(10) Patent No.: US 10,617,233 B2
(45) Date of Patent: Apr. 14, 2020

(54) PRODUCT DISPLAY

(71) Applicant: WestRock Container, LLC, Atlanta, GA (US)

(72) Inventor: Joe Ertl, Richfield, MN (US)

(73) Assignee: WestRock Container, LLC, Atlanta, GA (US)

( * ) Notice: Subject to any disclaimer, the term of this patent is extended or adjusted under 35 U.S.C. 154(b) by 0 days.

(21) Appl. No.: 16/031,060

(22) Filed: Jul. 10, 2018

(65) Prior Publication Data

US 2019/0008290 A1 Jan. 10, 2019

Related U.S. Application Data

(60) Provisional application No. 62/530,573, filed on Jul. 10, 2017.

(51) Int. Cl.

| | |
|---|---|
| ***A47F 5/11*** | (2006.01) |
| ***B65D 21/08*** | (2006.01) |
| ***G09F 23/00*** | (2006.01) |

(52) U.S. Cl.

CPC ..... *A47F 5/116* (2013.01); *B65D 21/086* (2013.01); *G09F 23/00* (2013.01)

(58) Field of Classification Search

CPC ..... A47F 5/116; A47F 5/0018; A47F 5/11; A47B 43/02; A47B 47/06; G09F 7/08; G09F 7/10; G09F 23/00; B65D 21/086

See application file for complete search history.

(56) References Cited

U.S. PATENT DOCUMENTS 990,918 A * 5/1911 Stadler ..... A63H 33/38 229/92.8
2,332,642 A * 10/1943 Johnson ..... G09F 1/04 229/169
2,609,137 A * 9/1952 Toensmeier ..... B65D 5/46008 206/166
3,647,114 A * 3/1972 Bleuer ..... A47K 10/422 221/279
3,784,055 A * 1/1974 Anderson ..... A47K 10/421 206/205
3,918,576 A * 11/1975 Taub ..... B65D 5/5206 206/764
4,646,922 A * 3/1987 Smith ..... A47F 5/116 211/132.1
4,854,060 A * 8/1989 Corbo ..... A47G 1/141 40/720
5,520,325 A * 5/1996 Quaintance ..... B65D 5/48026 229/120.26
5,979,338 A 11/1999 Salmanson
5,992,683 A * 11/1999 Sigl ..... A47K 10/422 221/52
6,126,131 A 10/2000 Tietz
6,244,194 B1 6/2001 Salmanson
6,386,371 B1 5/2002 Parsons
6,581,330 B1 6/2003 Helsloot
6,607,199 B2 8/2003 Gruber (Continued)

*Primary Examiner* — Ko H Chan

(74) *Attorney, Agent, or Firm* — WestRock IP Legal

(57) ABSTRACT

A product display in accordance with the present disclosure includes a display header and a product-support structure. The display header is coupled to the product-support structure for showing product indicia related to products stored in the product-support structure to a customer at a retail location.

14 Claims, 5 Drawing Sheets

(56) References Cited

U.S. PATENT DOCUMENTS

| | | | | |
|---|---|---|---|---|
| 6,609,466 | B2 | 8/2003 | Salmanson | |
| 6,648,172 | B2 * | 11/2003 | Leighton | A47K 10/421 206/233 |
| 6,722,292 | B2 | 4/2004 | Salmanson | |
| 6,857,642 | B2 | 2/2005 | Gruber | |
| 6,892,876 | B1 | 5/2005 | Aubry | |
| 6,925,943 | B2 | 8/2005 | Salmanson | |
| 7,104,553 | B2 | 9/2006 | Gruber | |
| 7,159,521 | B2 | 1/2007 | Salmanson | |
| 7,273,156 | B2 * | 9/2007 | Gao | B65D 83/0805 221/47 |
| 7,407,086 | B2 | 8/2008 | Borio | |
| 7,681,783 | B2 | 3/2010 | Stephenson | |
| 7,694,932 | B1 * | 4/2010 | Ngan | B42D 5/043 206/45.2 |
| 7,766,348 | B2 | 8/2010 | McFarland | |
| 7,845,894 | B2 | 12/2010 | Dickinson | |
| 8,167,255 | B2 * | 5/2012 | Tzuo | A47B 43/02 211/149 |
| 8,485,370 | B2 | 7/2013 | Dewhurst | |
| 8,561,816 | B2 | 10/2013 | Martin | |
| 8,584,860 | B2 | 11/2013 | Orischak | |
| 8,720,089 | B1 | 5/2014 | Lewis | |
| 8,733,563 | B2 | 5/2014 | Fadrowski | |
| 8,833,573 | B2 | 9/2014 | Tomaszewski | |
| 8,857,633 | B2 | 10/2014 | Dewhurst | |
| 8,863,417 | B2 | 10/2014 | Gerstner | |
| 8,978,280 | B2 | 3/2015 | Holt | |
| 8,991,624 | B2 | 3/2015 | Brozak | |
| 9,186,453 | B1 | 11/2015 | Russell | |
| 9,415,893 | B2 | 8/2016 | Wintermute | |
| 9,776,760 | B2 * | 10/2017 | Keeder | B65D 5/20 |
| 2016/0176570 | A1 | 6/2016 | Collier | |
| 2017/0267399 | A1 | 9/2017 | Buscema | |
| 2017/0297772 | A1 | 10/2017 | Davis | |

* cited by examiner

PRODUCT DISPLAY

PRIORITY CLAIM

This application claims priority under 35 U.S.C. § 119(e) to U.S. Provisional Application Ser. No. 62/530,573, filed Jul. 10, 2017, which is expressly incorporated by reference herein.

BACKGROUND

The present disclosure relates to a product display, and particularly to a product display having a display header and a product-support structure. More particularly, the present disclosure relates to a product display having a display header attached to a product-support structure for showing product indicia related to products stored in the product-support structure to a customer at a retail location.

SUMMARY

A product display in accordance with the present disclosure includes a display header and a product-support structure. The display header is coupled to the product-support structure for showing product indicia related to products stored in the product-support structure to a customer at a retail location.

In illustrative embodiments, the display header is positioned to extend around a perimeter of the product-support structure. The display header includes a header sleeve and a header mount. The header mount engages with the product-support structure and the header sleeve to support the header sleeve relative to the product-support structure.

In illustrative embodiments, the header sleeve defines at least three sides corresponding to an outer profile of the product-support structure. The product indicia is positioned on the sides of the header sleeve. The header sleeve is movable from a shipping position to a display position relative to the product-support structure. The header sleeve at least partially obscures a portion of the product-support structure in the shipping position.

In illustrative embodiments, the header mount includes a plurality of elastic members. The elastic members are configured to move the header sleeve from the shipping position to the display position at the selection of a user. The elastic members are coupled to the product-support structure and a lower end of the header sleeve to support the header sleeve relative to the product-support structure for movement between the shipping and display positions.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
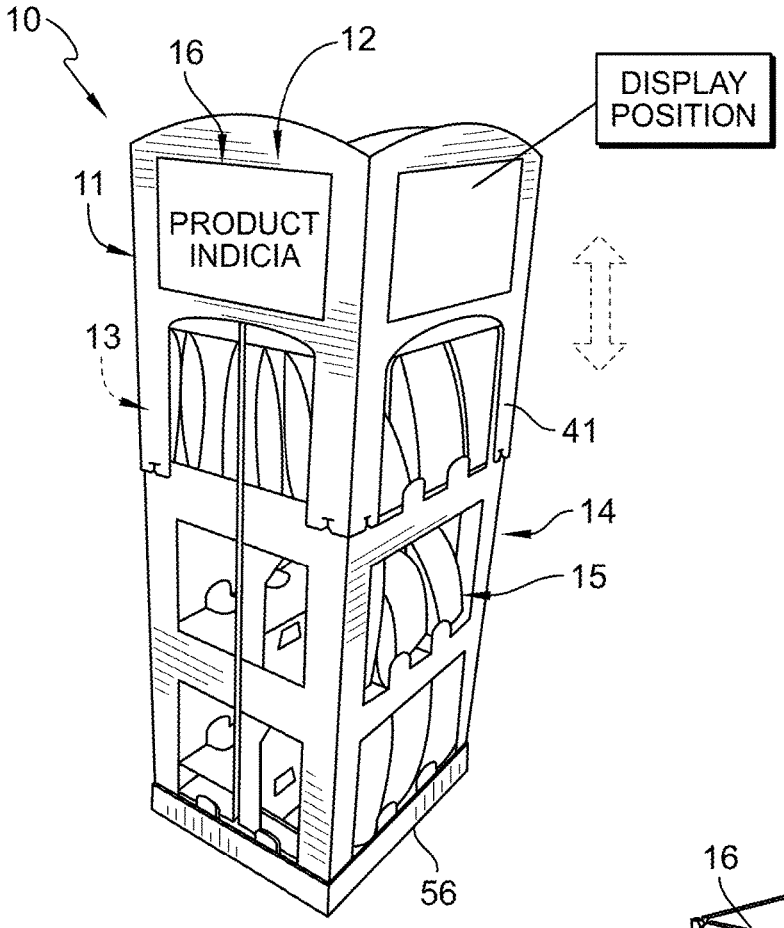
FIG. 1 is a front perspective view of a product display in accordance with the present disclosure showing that the product display includes a display header coupled to a product-support structure for showing product indicia related to products stored in the product-support structure to a customer at a retail location when the display header is in a display position.

A product display 10 in accordance with the present disclosure is shown in FIG. 1. Product display 10 includes a display header 12 coupled to a product-support structure 14. Product-support structure 14 includes a bottom end and a top end and is configured to support product 15 for display in a retail setting. Product indicia 16 related to products stored in product-support structure 14 is positioned on product indicia display areas on the sides of display header 12 and visible when display header 12 is in an extended display position as shown in FIG. 1.

Figure 2:
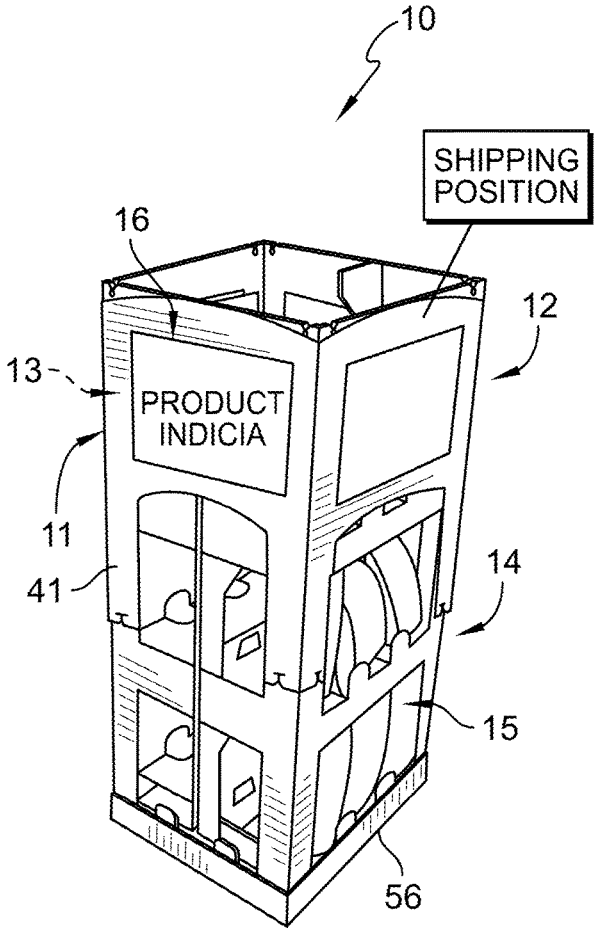
FIG. 2 is a view similar to FIG. 1 showing the display header in a shipping position and suggesting that a header sleeve of the display header slides along an exterior of the product-support structure to obscure at least a portion of the product-support structure when the header sleeve is moved to the shipping position.

Display header 12 includes a header sleeve 11 having a bottom end and a top end. A header mount 13 couples product-support structure 14 to support header sleeve 11 for sliding movement of display header 12 relative to product-support structure 14 along a vertical central axis between the extended display position, as shown in FIG. 1, and a retracted shipping position, as shown in FIG. 2, at the selection of a user. At least a portion of product-support structure 14 is obscured from view when header sleeve 11 is in the retracted shipping position. The height of product display 10 between the bottom end of product-support structure 14 and the top end of display header 12, when display header 12 is in the retracted shipping position, is reduced or shortened compared to the height of product display 10 when header sleeve 11 is in the extended display position. In the illustrative embodiment, header mount 13 biases header sleeve 11 toward the extended display position to support the header sleeve 11 in the extended display position for showing product indicia 16 to customers at a retail location as suggested in FIG. 1.

Header sleeve 11 extends around an outer perimeter of product-support structure 14 as suggested in FIGS. 1 and 2. Header sleeve 11 engages with exterior surfaces of product-support structure 14 to locate header sleeve 11 relative to product-support structure 14 and to guide header sleeve 11 when header sleeve 11 is slid between the extended display position and the retracted shipping position. While product-support structure 14 and header sleeve 11 are shown as rectangular in FIGS. 1 and 2, other shapes are contemplated by the present disclosure, including, but not limited to, circular, triangular, octagonal, and other geometric and non-geometric shapes. In some embodiments, header sleeve 11 and product-support structure 14 are of similar shape. In some embodiments, header sleeve 11 is a different shape than product-support structure 14. Header sleeves having three or more sides maximize rigidity of the header sleeve.

Figure 3:
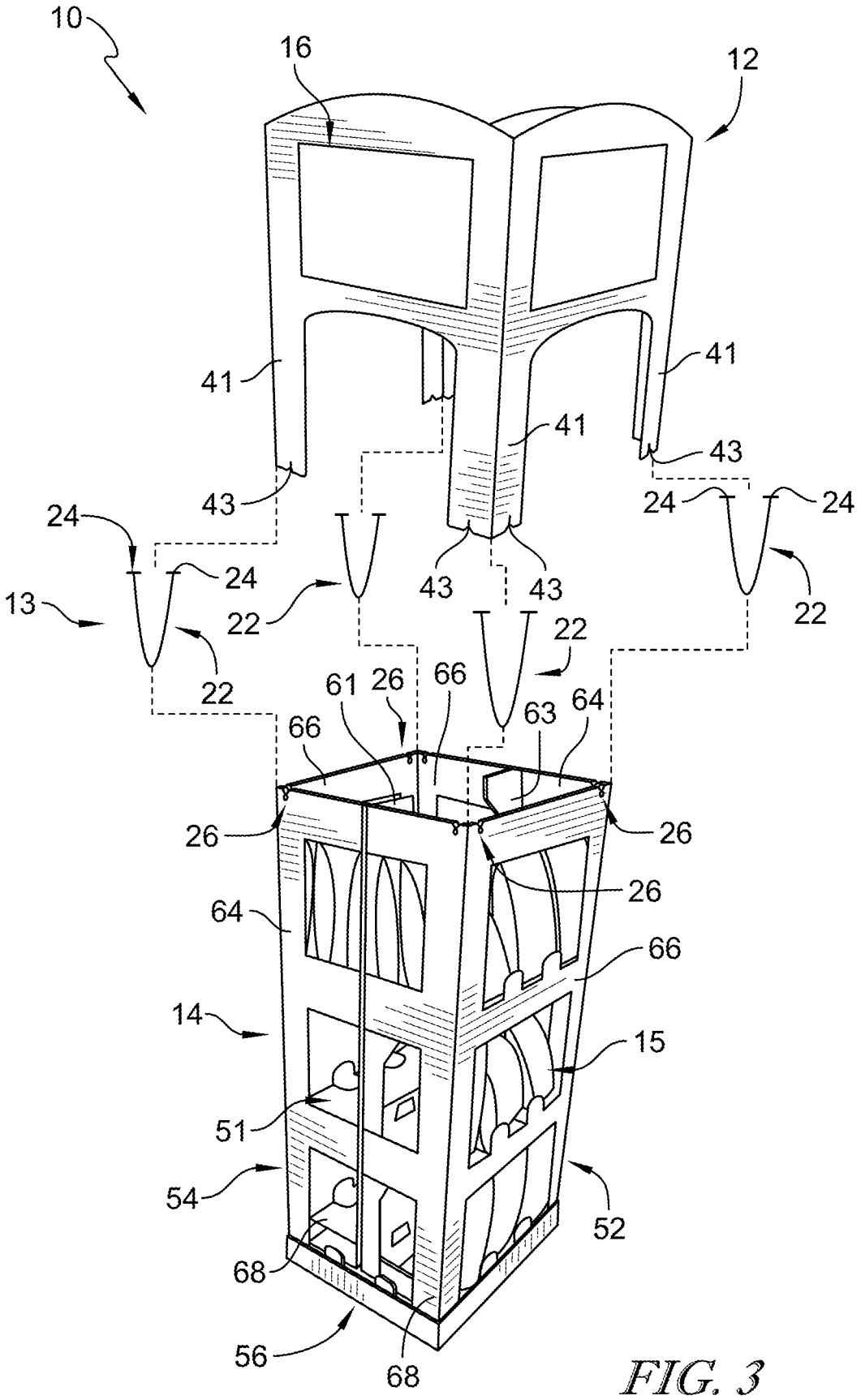
FIG. 3 is an exploded assembly view of the product display of FIG. 1 showing that elastic members engage with the header sleeve and product-support structure to support the header sleeve on the product-support structure.

Header mount 13 includes a plurality of elastic members 22 that engage with product-support structure 14 and header sleeve 11 to resiliently support header sleeve 11 on product-support structure 14 as shown in FIG. 3. In some embodiments, elastic members 22 are formed as elongated strands of resiliently stretchable material, and the number of elastic members 22 can be increased or decreased to adjust for size, weight, display position height, etc. of display header 12. Barbs 24 positioned at opposing ends of elastic members 22 engage with header sleeve 11, and the center portions of elastic members 22 extend into slots 26 formed in upper corners of product-support structure 14 as header sleeve 11 slides onto product-support structure 14.

Figure 4:
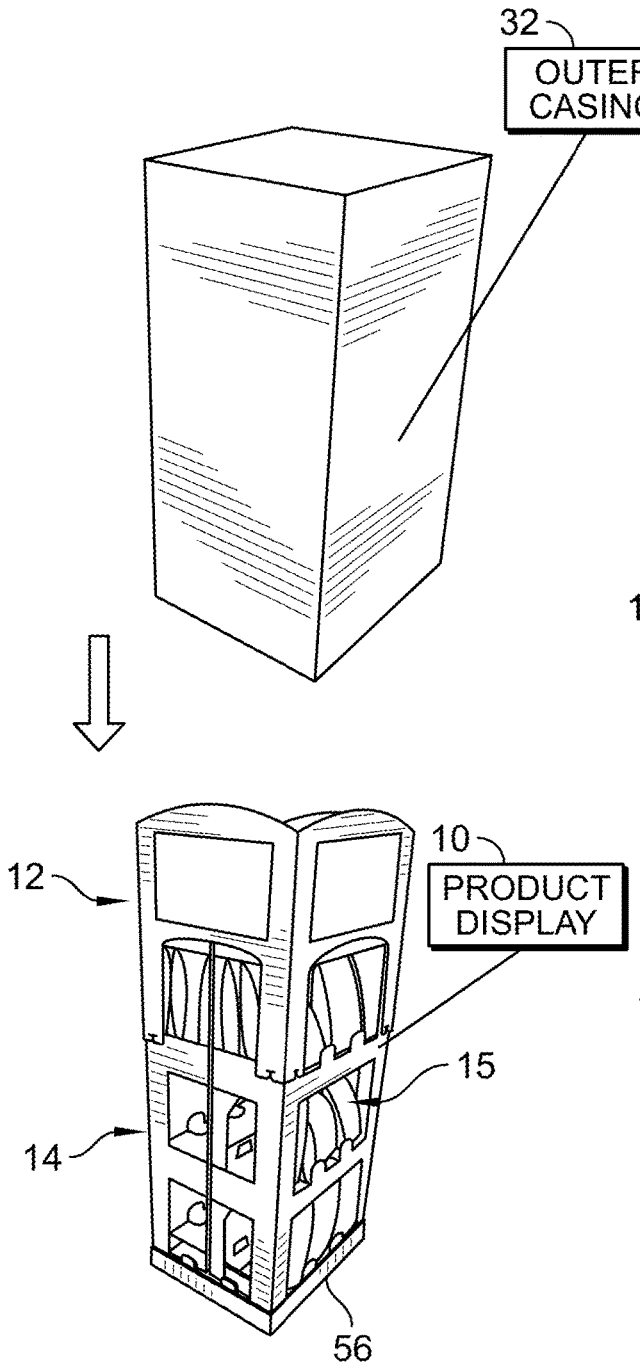
FIGS. 4 and 5 are a series of views showing a process in accordance with the present disclosure for forming a transport package by positioning an outer casing relative to the product display.
Figure 5:
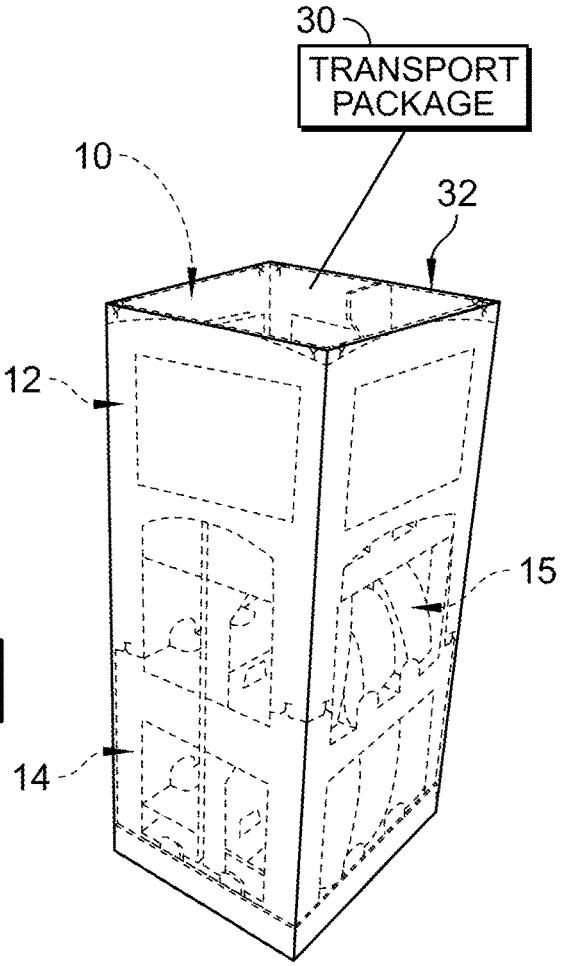

One illustrative process for assembling a transport package 30 is shown in FIGS. 4 and 5. An outer casing 32 is sized to receive product display 10 therein. Outer casing 32 is positioned to surround product display 10 to form transport package 30 and retain product 15 on product-support structure 14. Outer casing 32 moves display header 12 from the extended display position to the retracted shipping position and holds display header 12 in the retracted shipping position during transit of product display 10 to a retail location. A user of product display 10 removes outer casing 32 to expose product 15 stored in product-support structure 14 and header mount 13 moves header sleeve 11 to the extended display position for showing product indicia 16 to customers at the retail location.

Figure 6:
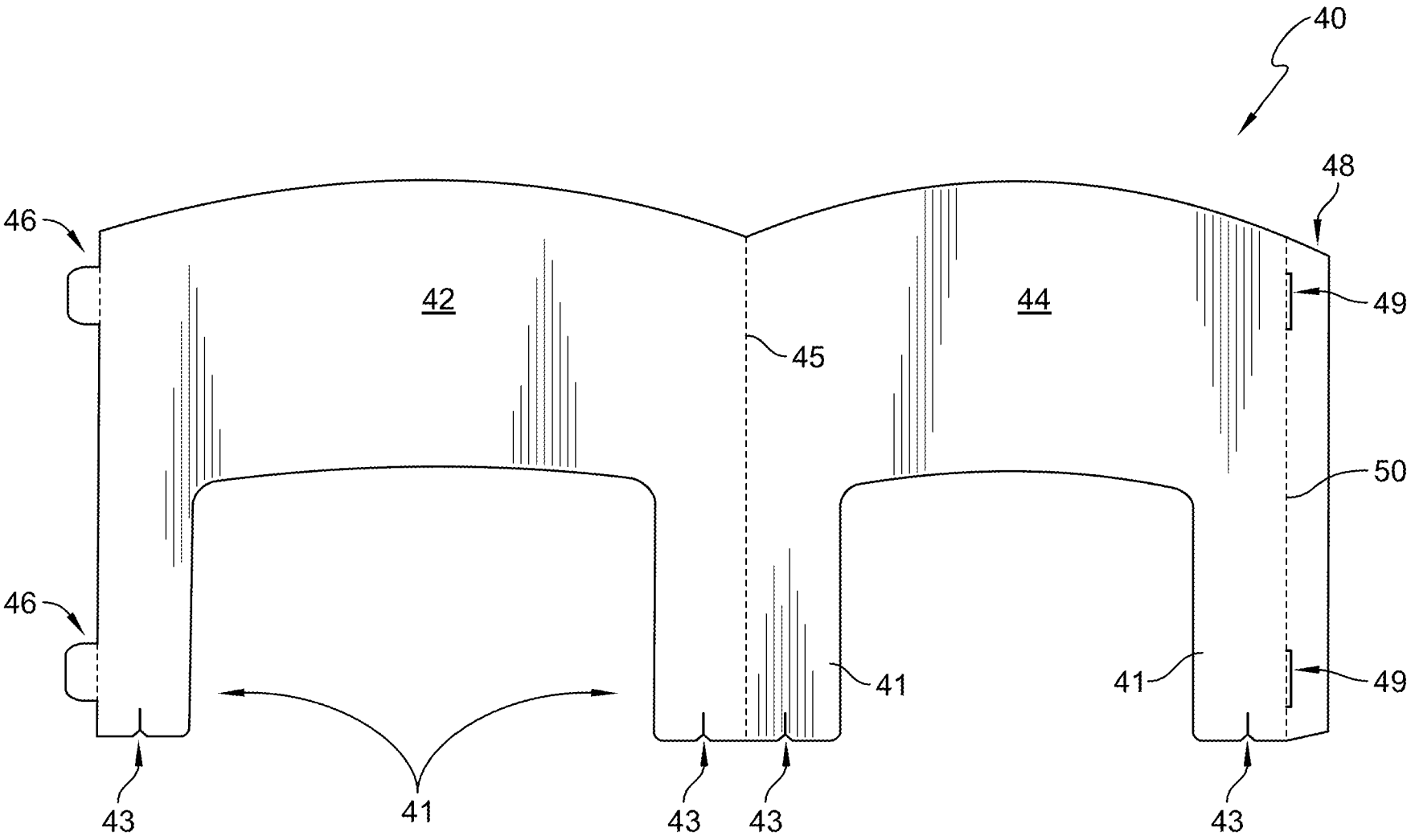
FIG. 6 is a top plan view of an embodiment of a sleeve-part blank in accordance with the present disclosure used in combination with another sleeve-part blank to form the header sleeve of FIG. 2 showing that the sleeve-part blank includes sidewall panels, connector tabs, and connector slots and suggesting that the connector tabs of one sleeve-part blank engage with the connector slots of another sleeve-part blank and are folded to form the header sleeve.

A sleeve-part blank 40 used to form header sleeve 11 is shown in FIG. 6. Sleeve-part blank 40 includes sidewall panels 42, 44 coupled to one another along fold line 45, and legs 41 extending downward from sidewall panels 42, 44. Each leg 41 includes one or more slots 43 configured to receive elastic members 22. Connector tabs 46 are coupled to sidewall panel 42 and a flap 48 is coupled to sidewall panel 44 along fold line 50 to define connector slots 49. As shown and described herein, when making reference to a blank of material, solid lines denote a cut line where adjacent portions of material are severed from one another and dashed lines denote a fold line where portions of material are folded relative to one another. In some examples, fold lines are scored or perforated.

In one illustrative embodiment of a process for forming header sleeve 11, connector tabs 46 of a first sleeve-part blank 40 are inserted into connector slots 49 of a second sleeve-part blank 40. The first and second sleeve-part blanks 40 are folded (along the dashed fold lines 45 and 50 shown in FIG. 6) to allow connector tabs 46 of the second sleeve-part blank 40 to be inserted into connector slots 49 of the second sleeve-part blank 40 to form a rectangular header sleeve 11. In some embodiments, more than two sleeve-part blanks 40 are coupled together to form header sleeves of different shapes. In some embodiments, a single sleeve blank having three or more sidewall panels is folded to form a header sleeve.

Figure 7:
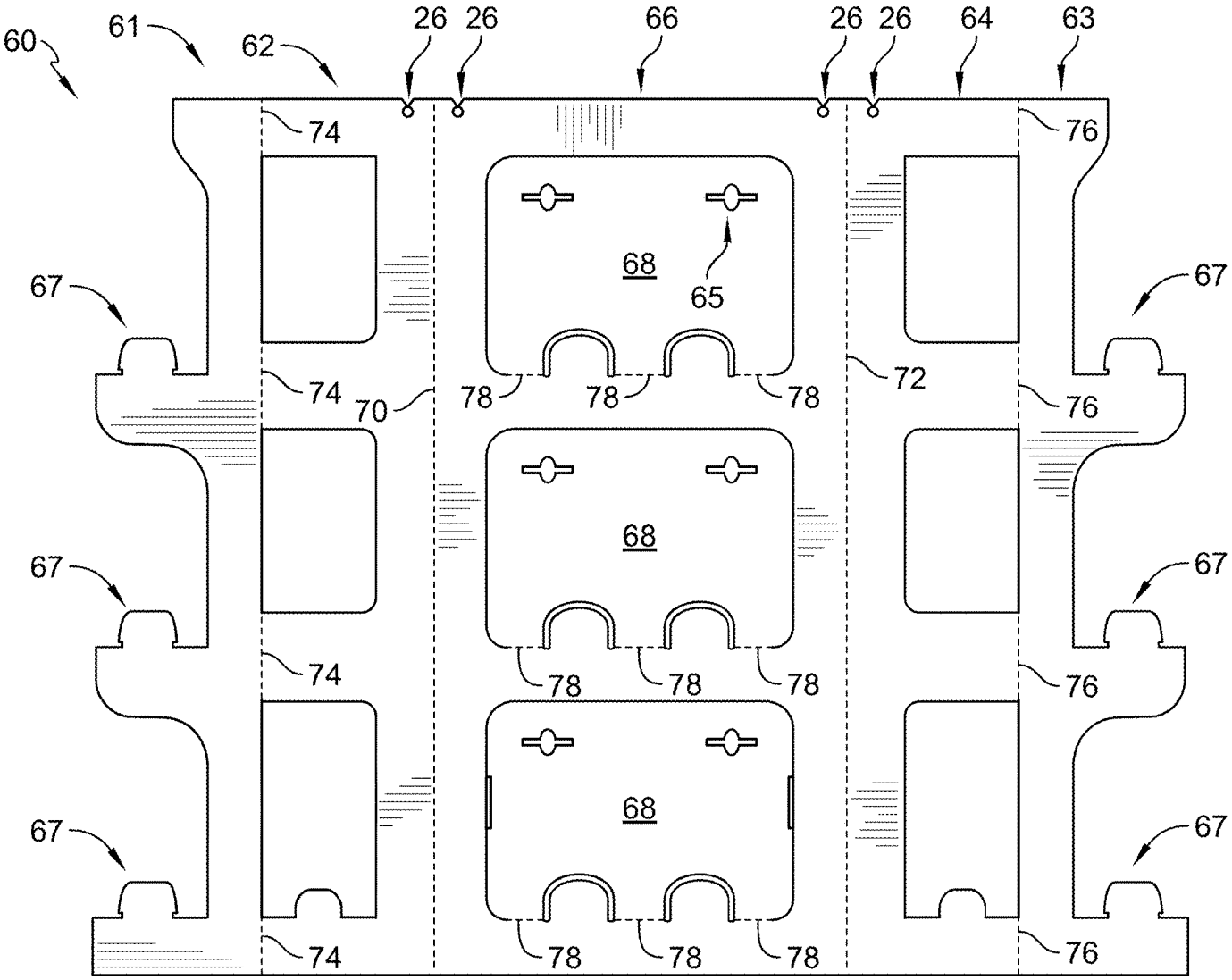
FIG. 7 is a top plan view of an embodiment of a cabinet blank in accordance with the present disclosure used to form a cabinet of the product-support structure of FIG. 2 showing that the cabinet blank includes sidewall panels, support panels, and a front wall panel defining a plurality of shelf parts and suggesting that the panels fold relative to one another and the shelf parts fold relative to the front wall panel to engage with the support panels to form the cabinet.

Product-support structure 14 includes a pair of opposingly faced cabinets 52, 54 received in a base tray 56 as shown in FIG. 3. Base tray 56 includes a bottom wall and a plurality of side walls that form a chamber having a top opening. Each cabinet 52, 54 is formed to define product-storage areas 51. Base tray 56 assists in holding the components of product-support structure 14 together and for supporting product-support structure 14 during transport. Each cabinet 52, 54 is formed from a cabinet blank 60 shown in FIG. 7. Cabinet blank 60 includes sidewall panels 62, 64 coupled along panel fold lines 70 and 72 to a front wall panel 66. Each sidewall panel 62 and 64 includes a plurality of openings. Support panels 61, 63 are coupled to sidewall panels 62, 64, respectively, along panel fold lines 74 and 76. A plurality of shelf parts 68 are defined within front wall 66 and are coupled to front wall 66 along fold lines 78. Cabinet blank 60 is folded (along the dashed panel fold lines shown in FIG. 7) to form one of cabinets 52, 54. Slots 65 of shelf parts 68 engage with tabs 67 of support panels 61, 63 to support shelf parts 68 and define supporting surfaces in product-storage areas 51 of cabinets 52, 54.

It is within the scope of the present disclosure to make product-support structures, header sleeves, and trays in accordance with the present disclosure from a variety of materials including corrugated paperboard, folding carton, solid fiber, plastic sheeting, plastic corrugated, combinations thereof, or any other suitable material. In illustrative embodiments, product-support structures, header sleeves, and trays may be formed from the same or different materials.

In illustrative embodiments, product displays can be of various sized, such as ¼ pallet, half pallet, and full pallet for example. Product-support structures can be formed using various display vehicles, such as cabinets, risers, stacked trays, three-sided structures, and other structures that support or otherwise store product for display and transportation. The display vehicles can be of various sizes.

In illustrative embodiments, the display headers automatically pop-up when used. The display headers are adaptable for use with a variety of product-support structures in a retail environment.

In illustrative embodiments, the display headers include elastic bands and a graphic header sleeve which in combination attach to a product-support structure. Once the display header is attached to a product-support structure, the graphic header sleeve is moved into the down retracted position for shipment. A shrink film or corrugated shroud are placed around the product-support structure and display header to protect it for shipment. Once the product display arrives to its intended destination (e.g., a retail location), a user removes the protective cover and the header sleeve will automatically be lifted upward via the elastic bands into the up extended position for showing the graphics on the exterior facing sides of the header sleeve.

In illustrative embodiments, no labor is involved by a user in the retail setting. This solves a problem in that current graphic headers ship loose or separate from the display vehicle. Many times those loose headers are placed on the top or may be attached via plastic rivets or clips. In either case, a user must find the header (if loose), read the set up instruction sheet, and attach the header to the display vehicle. The display headers of the present disclosure automatically moves the graphic element (e.g., header sleeve) up into position meeting retail compliance requirements and saving labor.

The invention claimed is:

1. A product display comprising:

a product-support structure having a bottom end and a top end and including one or more product storage areas, each product storage area adapted to display a product, the product-support structure including an outer peripheral surface extending around the perimeter of the product-support structure;

a display header slidably coupled to the product-support structure, the display header including a bottom end, a top end, and a header sleeve extending around the outer peripheral surface of the product-support structure, the product display having a height extending between the bottom end of the product-support structure and the top end of the display header;

a header mount slidably coupling the display header to the product-support structure;

wherein the display header is slidable along the outer peripheral surface of the product-support structure between a retracted shipping position and an extended display position, the height of the product display when the display header is in the retracted shipping position being shorter than the height of the product display when the display header is in the extended display position;

wherein the product-support structure includes a cabinet formed from a cabinet blank, the cabinet blank including a front wall panel, a plurality of shelf parts coupled to the front wall panel along respective fold lines, a first sidewall panel coupled to the front wall panel along a fold line, a second sidewall panel coupled to the front wall panel along a fold line, the first and second sidewall panels being generally perpendicular to the front wall panel and generally parallel to one another.

2. The product display of claim 1, wherein the header sleeve of the display header includes one or more product indicia display areas, the product indicia display areas adapted to at least partially obscure one or more of the product storage areas of the product-support structure when the display header is in the retracted shipping position.

3. The product display of claim 2, wherein the display header includes a plurality of legs, the legs extending from the product indicia display areas of the header sleeve, each leg includes a distal end located at the bottom end of the display header.

4. A product display comprising:

a product-support structure having a bottom end and a top end and including one or more product storage areas, each product storage area adapted to display a product, the product-support structure including an outer peripheral surface extending around the perimeter of the product-support structure;

a display header slidably coupled to the product-support structure, the display header including a bottom end, a top end, and a header sleeve extending around the outer peripheral surface of the product-support structure, the product display having a height extending between the bottom end of the product-support structure and the top end of the display header;

a header mount slidably coupling the display header to the product-support structure;

wherein the display header is slidable along the outer peripheral surface of the product-support structure between a retracted shipping position and an extended display position, the height of the product display when the display header is in the retracted shipping position being shorter than the height of the product display when the display header is in the extended display position;

wherein the header mount comprises one or more elastic members, the elastic members resiliently biasing the display header from the retracted shipping position toward the extended display position with respect to the product-support structure;

wherein each elastic member is coupled to the top end of the product-support structure and is coupled to the bottom end of the display header;

wherein the top end of the product-support structure includes a plurality of slots adapted to receive the one or more elastic members, and the bottom end of the display header includes a plurality of slots adapted to receive the one or more elastic members.

5. The product display of claim 4, wherein each elastic member includes a first end, a second end, and a center portion located between the first end and the second end, the first end and the second end of each elastic member being coupled to one of the product-support structure and the display header, and the center portion of each elastic member being coupled to the other one of the product-support structure and the display header.

6. The product display of claim 1, wherein the display header includes a first sleeve-part blank coupled to a second sleeve-part blank, each sleeve-part blank including a first sidewall panel and a second sidewall panel coupled to the first sidewall panel, each first and second sidewall panel including a first leg and a second leg spaced apart from and generally parallel to the first leg, each leg including a distal end having a slot.

7. The product display of claim 6, wherein the first sidewall panel of each sleeve-part blank includes one or more connector tabs, and the second sidewall panel of each sleeve-part blank includes one or more connector slots, the tabs of the first sidewall panel of the first sleeve-part blank adapted to be inserted into the slots of the second sidewall panel of the second sleeve-part blank.

8. The product display of claim 1, wherein the product-support structure includes a first cabinet and a second cabinet coupled to the first cabinet, the first cabinet and the second cabinet each including a plurality of product storage areas.

9. The product display of claim 1, wherein each shelf part includes a plurality of slots, a first support panel having a plurality of tabs is coupled to the first sidewall panel along a fold line, and a second support panel having a plurality of tabs is coupled to the second sidewall panel along a fold line, each tab of the first support panel adapted to be received in a respective one of said plurality of slots, and each tab of the second support panel adapted to be received in a respective one of said plurality of slots.

10. The product display of claim 1, including a base tray having a chamber with a top opening formed by a plurality of sidewalls, the bottom end of the product-support structure located within the chamber.

11. The product display of claim 1, including a removable outer casing that surrounds the product-support structure and the display header when the display header is in the retracted position, the casing adapted to retain the display header in the retracted position until the casing is removed.

12. A cabinet blank for a product display, the cabinet blank comprising:

a front wall panel;

a plurality of shelf parts, each shelf part coupled to the front wall panel along a shelf fold line;

a first sidewall panel coupled to the front wall panel along a first panel fold line;

a second sidewall panel coupled to the front wall panel along a second panel fold line, the second panel fold line being generally parallel to the first panel fold line;

a first support panel coupled to the first sidewall panel along a third panel fold line, the third panel fold line being generally parallel to the first panel fold line;

a second support panel coupled to the second sidewall panel along a fourth panel fold line, the fourth panel fold line being generally parallel to the second panel fold line.

13. The cabinet blank of claim 12, wherein each shelf part includes a plurality of slots, the first support panel includes a plurality of tabs, and the second support panel includes a plurality of tabs, each tab adapted to be inserted into a slot of a shelf part.

14. The cabinet blank of claim 12, wherein the first sidewall panel includes a plurality of openings, and the second sidewall panel includes a plurality of openings.

* * * * *